US007637316B2

(12) United States Patent
Best et al.

(10) Patent No.: US 7,637,316 B2
(45) Date of Patent: Dec. 29, 2009

(54) WELLBORE SYSTEM

(75) Inventors: Bruno Best, Rijswijk (NL); Albert Cornelis Pols, Rijswijk (NL)

(73) Assignee: Shell Oil Company, Houston, TX (US)

( * ) Notice: Subject to any disclaimer, the term of this patent is extended or adjusted under 35 U.S.C. 154(b) by 97 days.

(21) Appl. No.: 12/093,699

(22) PCT Filed: Nov. 14, 2006

(86) PCT No.: PCT/EP2006/068413

§ 371 (c)(1),
(2), (4) Date: May 14, 2008

(87) PCT Pub. No.: WO2007/057378

PCT Pub. Date: May 24, 2007

(65) Prior Publication Data

US 2008/0236808 A1 Oct. 2, 2008

(30) Foreign Application Priority Data

Nov. 16, 2005 (EP) ..... 05077611

(51) Int. Cl.
*E21B 43/013* (2006.01)
*E21B 43/30* (2006.01)

(52) U.S. Cl. ..... 166/50; 166/52; 166/245

(58) Field of Classification Search ..... 166/245, 166/50, 52, 313
See application file for complete search history.

(56) References Cited

U.S. PATENT DOCUMENTS

| | | | | |
|---|---|---|---|---|
| 4,553,879 | A | 11/1985 | Langner | 405/270 |
| 5,070,462 | A | 12/1991 | Chau | 364/460 |
| 5,343,152 | A | 8/1994 | Kuckes | 324/346 |
| 5,472,048 | A | 12/1995 | Kennedy et al. | 166/50 |
| 6,026,913 | A | 2/2000 | Mandal et al. | 175/45 |
| 6,119,776 | A * | 9/2000 | Graham et al. | 166/245 |
| 6,279,658 | B1 | 8/2001 | Donovan et al. | 166/313 |
| 6,318,457 | B1 | 11/2001 | Den Boer et al. | 166/66.7 |
| 7,063,145 | B2 * | 6/2006 | Veenstra et al. | 166/250.01 |
| 7,419,005 | B2 * | 9/2008 | Al-Muraikhi | 166/306 |
| 7,513,304 | B2 * | 4/2009 | Stayton | 166/245 |
| 2004/0079530 | A1 | 4/2004 | Ribeiro Lima et al. | 166/366 |
| 2006/0124360 | A1 * | 6/2006 | Lee et al. | 175/61 |
| 2006/0157242 | A1 * | 7/2006 | Graham et al. | 166/268 |

FOREIGN PATENT DOCUMENTS

| | | |
|---|---|---|
| EP | 671549 | 9/1995 |
| EP | 875661 | 11/1998 |
| WO | WO9960248 | 11/1999 |

* cited by examiner

*Primary Examiner*—Kenneth Thompson

(57) ABSTRACT

A wellbore system is provided for the production of hydrocarbon fluid from a hydrocarbon fluid reservoir (4) in an earth formation. The wellbore system comprises a first wellbore (18) drilled from a first surface location at a horizontal distance from the hydrocarbon fluid reservoir, the first wellbore having a lower section (10) extending from a rock formation outside the reservoir, into the reservoir, and a second wellbore (20) drilled from a second surface location horizontally displaced from the first surface location. The second wellbore (20) extend towards the first wellbore (18) and is in fluid communication with the reservoir (4) via said lower section (10) of the first wellbore.

11 Claims, 5 Drawing Sheets

WELLBORE SYSTEM

PRIORITY CLAIM

The present application claims priority from European Patent Application 05077611.1 filed 16 Nov. 2005.

FIELD OF THE INVENTION

The present invention relates to a wellbore system for the production of hydrocarbon fluid from a remotely located subsurface hydrocarbon fluid reservoir.

BACKGROUND OF THE INVENTION

In operations for the production of oil or gas from reservoir at a remote location, such as an offshore reservoir, it is common practice to produce hydrocarbon fluid from one or more wells to a production platform located at the site of the wells. The production platform can be fixedly installed on the seabed, such as a jack-up platform or a gravity based platform, or it can be floating at the sea surface, such as a floating production storage and offloading (FPSO) vessel. Generally, one or more wells are drilled into the reservoir from directly below the platform, and hydrocarbon fluid is produced from the wells through risers extending between the seabed and the platform. Most offshore fields also involve one or more satellite wells located at a distance from the platform and tied to the platform by pipelines on the seabed.

Offshore platforms, especially those in deep water, attribute considerably to the costs of exploiting offshore hydrocarbon reservoirs. In some instances, installing an offshore platform may even be prohibitive to economical exploitation of the reservoir. In view thereof it has been proposed to use relatively small subsea production systems instead of fixed or floating platforms for producing oil or gas from offshore fields. Such subsea systems are arranged to receive hydrocarbon fluid from one or more wells to initially separate the produced stream into a gas stream and a liquid stream, and to pump the separated streams to an onshore production facility. Alternatively the produced fluids can be transported in multi-phase flow from the subsea system to an onshore facility through a single pipeline, hence without initial separation of gas from liquid.

Although conventional technologies can be applied for the exploitation of some remote hydrocarbon fluid reservoirs, a variety of applications require improved systems and methods to produce hydrocarbon fluid in an economical way. For example, the production of hydrocarbon fluid from reservoirs located below Arctic offshore waters can prove difficult, if not impossible, with conventional technologies. Generally Arctic conditions prohibit continued operation of offshore facilities throughout the year, for example because the sea is frozen a large part of the year. For this reason, conventional offshore drilling and/or production platforms are considered inadequate for continued operation throughout the year in Arctic conditions. Moreover, exposure of pipelines to scouring from floating ice and/or hazards associated with unstable permafrost, can be prohibitive.

US patent publication 2004/0079530 discloses a wellbore system whereby a multilateral well is drilled into an offshore hydrocarbon reservoir from an first surface location vertically above the reservoir, and whereby a second well is drilled from a second surface location horizontally displaced from the first surface location. The second well extends inclined or horizontally in the direction of the multilateral well and is fluidly connected to a branch of the multilateral well. In use hydrocarbon fluid is produced from the reservoir, through the multilateral well and through the second well, to a production platform at the second surface location. However, the known wellbore system is only feasible if the second surface location is located not too far away from the hydrocarbon reservoir. The reason is that the depth at which inclined or horizontal wellbores can be drilled is limited due to anticipated problems such as low weight on bit, insufficient wellbore cleaning, differential sticking and high frictional forces acting on the drill string.

Accordingly there is a need for an improved wellbore system for the production of hydrocarbon fluid from a reservoir at a remote location, which overcomes the problems of the know system.

SUMMARY OF THE INVENTION

In accordance with the invention there is provided a wellbore system for the production of hydrocarbon fluid from a hydrocarbon fluid reservoir in an earth formation, the wellbore system comprising:

a first wellbore drilled from a first surface location at a horizontal distance from the hydrocarbon fluid reservoir, the first wellbore having a lower section extending from a rock formation outside the reservoir, into the reservoir; and a second wellbore drilled from a second surface location horizontally displaced from the first surface location, the second wellbore extending towards the first wellbore and being in fluid communication with the reservoir via said lower section of the first wellbore.

By drilling the first wellbore from the surface location at a horizontal distance from the reservoir, whereby said lower section of the first wellbore extends from the rock formation outside the reservoir into the reservoir, it is achieved that the second wellbore can be connected to the first wellbore at a location away from the reservoir, thus allowing the second wellbore to be drilled from a surface location located even further away from the reservoir. As a result, hydrocarbon fluid can be transported from the reservoir, through said lower section of the first wellbore and through the second wellbore, to a production facility located at a large horizontal distance from the reservoir.

Suitably the first wellbore is a multilateral wellbore comprising a main borehole, and primary and a secondary branch boreholes extending from the main borehole, wherein said lower section of the first wellbore is formed by the primary branch borehole, and wherein said second wellbore is fluidly connected to the secondary branch borehole. For example, the second wellbore can be connected to the secondary branch borehole using a drilling technique generally referred to as "homing-in" that has been applied for drilling of relief wells in blowout situations.

If the stream of hydrocarbon fluid needs to be pumped to the production facility, suitably the main borehole is provided with a pump arranged to pump hydrocarbon fluid from the primary branch borehole into the secondary branch borehole.

For example, the main borehole can be provided with a junction device having a primary through-bore in fluid communication with the primary branch borehole, and a secondary through-bore in fluid communication with the secondary branch borehole. A suitable junction device is the Downhole Splitter™ marketed by Baker Oil Tools. Also, a suitable junction device is disclosed in U.S. Pat. No. 5,472,048, the disclosure of which is incorporated herein by reference.

Suitably the pump has an inlet in fluid communication with the primary through-bore of the junction device, and an outlet in fluid communication with the secondary through-bore of the junction device.

The first wellbore preferably is provided with a closure device, such as a plug, arranged to prevent flow of hydrocarbon fluid through the first wellbore to the first surface location. The closure device suitably is arranged at a location below said first surface location.

To allow workover operations to be carried out from the first surface locations, it is preferred that the closure device can be opened so as to selectively allow passage of wellbore tools from the first surface location, through the first wellbore, to a location down-hole of the closure device.

BRIEF DESCRIPTION OF THE DRAWINGS

The invention will be described hereinafter by way of example in more detail, with reference to the accompanying drawings in which.

DETAILED DESCRIPTION OF THE INVENTION

Figure 1:
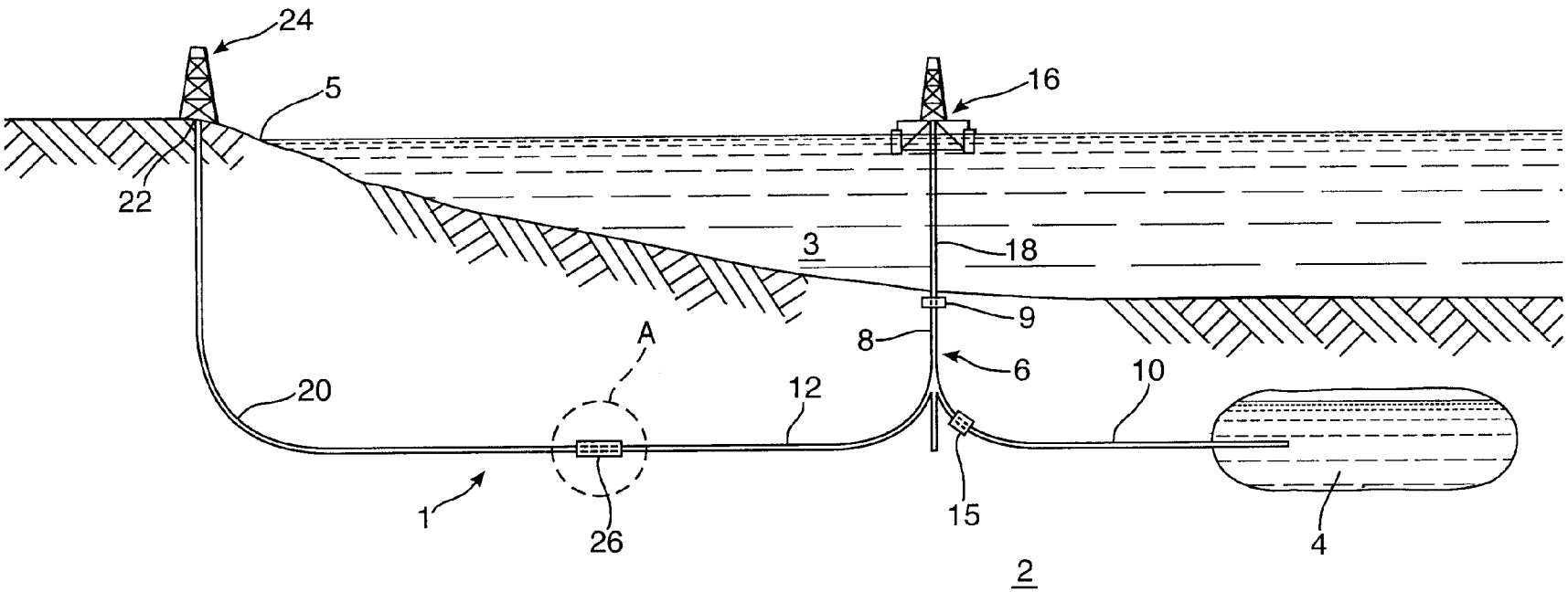
FIG. 1 schematically shows an embodiment of a wellbore system according to the invention, during the construction phase.

In the Figures like reference numerals relate to like components.

Referring to FIG. 1 there is shown a wellbore system 1 formed in an earth formation 2 extending from shore 5 to below a body of seawater 3 at an arctic location. A subsurface hydrocarbon fluid reservoir 4 is located at a considerable distance from shore 5, the reservoir 4 being formed of a rock formation with hydrocarbon fluid trapped in the pores of the rock formation. The wellbore system 1 includes a multilateral wellbore 6 having a main borehole 8 extending from a wellhead 9 vertically downward, a primary branch borehole 10 and a secondary branch borehole 12. The wellhead 9 is arranged below the seabed to protect the wellhead 9 against damage due to, for example, scouring from floating ice. Further, the wellhead 9 and the main borehole 8 are located at a horizontal distance from the hydrocarbon fluid reservoir 4. The branch boreholes 10, 12 extend in horizontal direction away from the main borehole 8 whereby the primary branch borehole 10 passes into the reservoir 4 and the secondary branch borehole 12 extends in a direction substantially opposite to the primary branch borehole 10. A surface-controlled subsurface safety valve (SCSSV) 15 is arranged in the primary branch borehole 10 near the junction thereof with the main borehole 8. The main borehole 8 is connected to a drilling vessel 16 floating at the sea surface by means of a riser 18 extending from the wellhead 9 to the drilling vessel 16.

The wellbore system furthermore includes a deviated wellbore 20 drilled from an onshore location 22 at which a drilling rig 24 is positioned. The deviated wellbore 20 first extends substantially vertically downward, and then deviates into a substantially horizontal direction to a point 26 where the deviated wellbore 20 intersects the secondary branch borehole 12 of multilateral wellbore 6.

Figure 2:
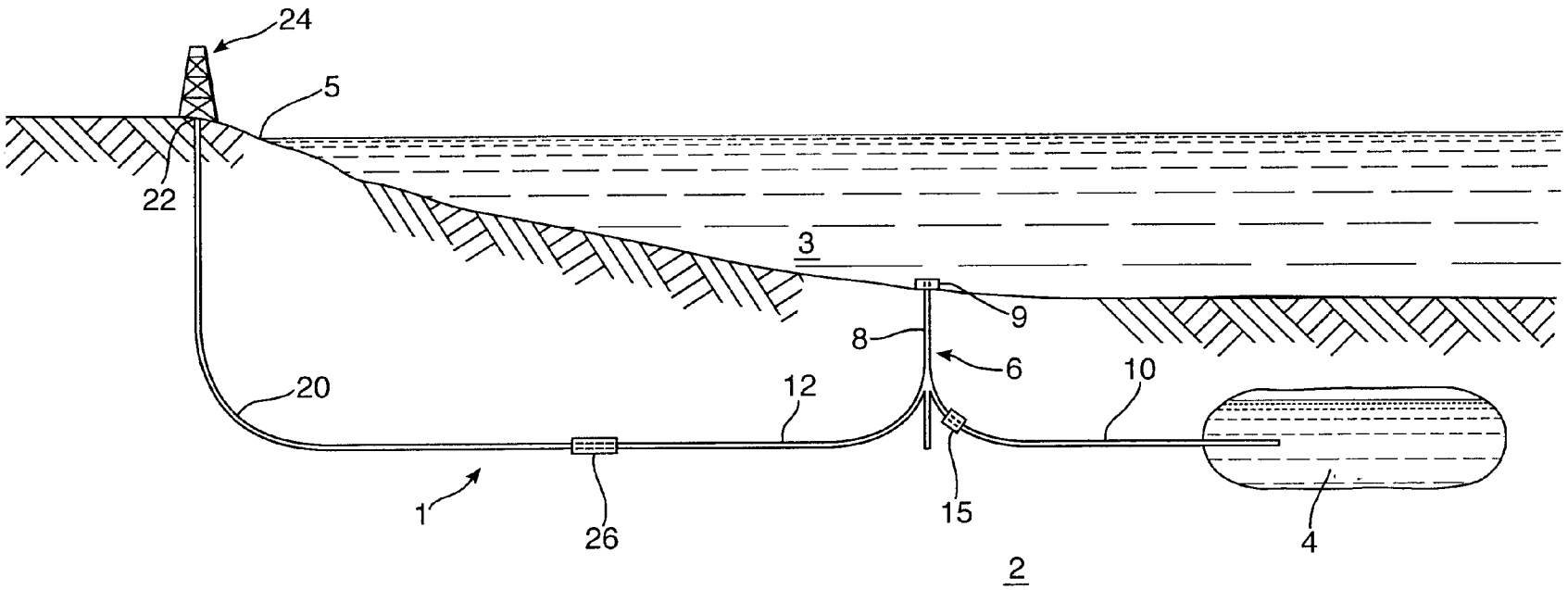
FIG. 2 schematically shows the wellbore system of FIG. 1, during normal operation.

FIG. 2 shows the wellbore system 1 after the drilling vessel 16 and the riser 18 have been moved away from the site of the multilateral wellbore 6.

Figure 3:
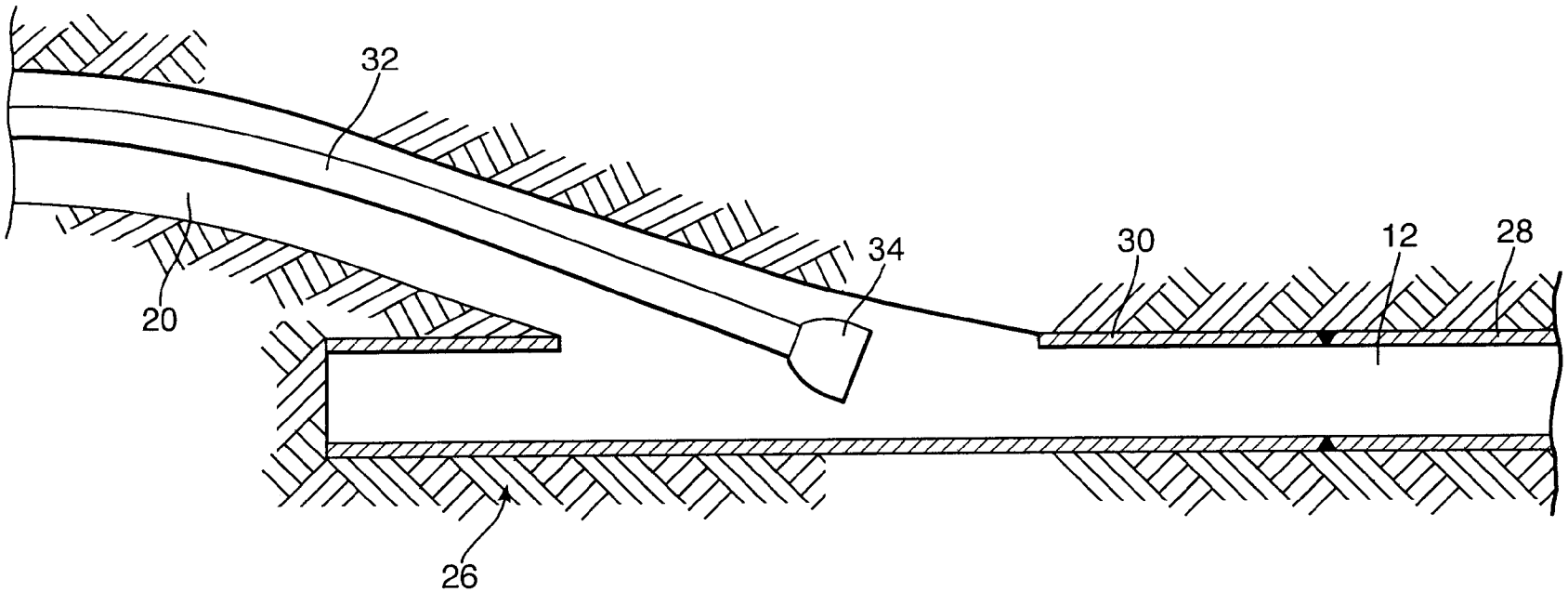
FIG. 3 schematically shows a connection between a first wellbore and a second wellbore included in the wellbore system of FIG. 1, during construction thereof.

FIG. 3 shows the point of intersection 26 of the deviated wellbore 20 and the secondary branch borehole 12 of multilateral wellbore 6 in more detail, during the drilling phase. The secondary branch borehole 12 of multilateral wellbore 6 is (optionally) provided with a casing 28 having a non-magnetisable end portion 30 provided with magnets (not shown). It is to be understood that the word "casing" in this context is meant to refer to a wellbore liner or to a wellbore casing. Both are tubular members to stabilize the borehole and to serve other useful purposes, whereby it is generally understood that a casing extends the full length to surface, whereas a liner extends only through a lower portion of the borehole. A drill string 32 extends from the drilling rig 24 to the bottom of the deviated wellbore 20. The drill string 32 is provided with a drill bit 34 at its lower end, and with a magnetic field sensor (not shown) arranged in a lower portion of the drill string 32. A suitable magnetic field sensor for practicing the invention is described in U.S. Pat. No. 5,343,152.

Figure 4:
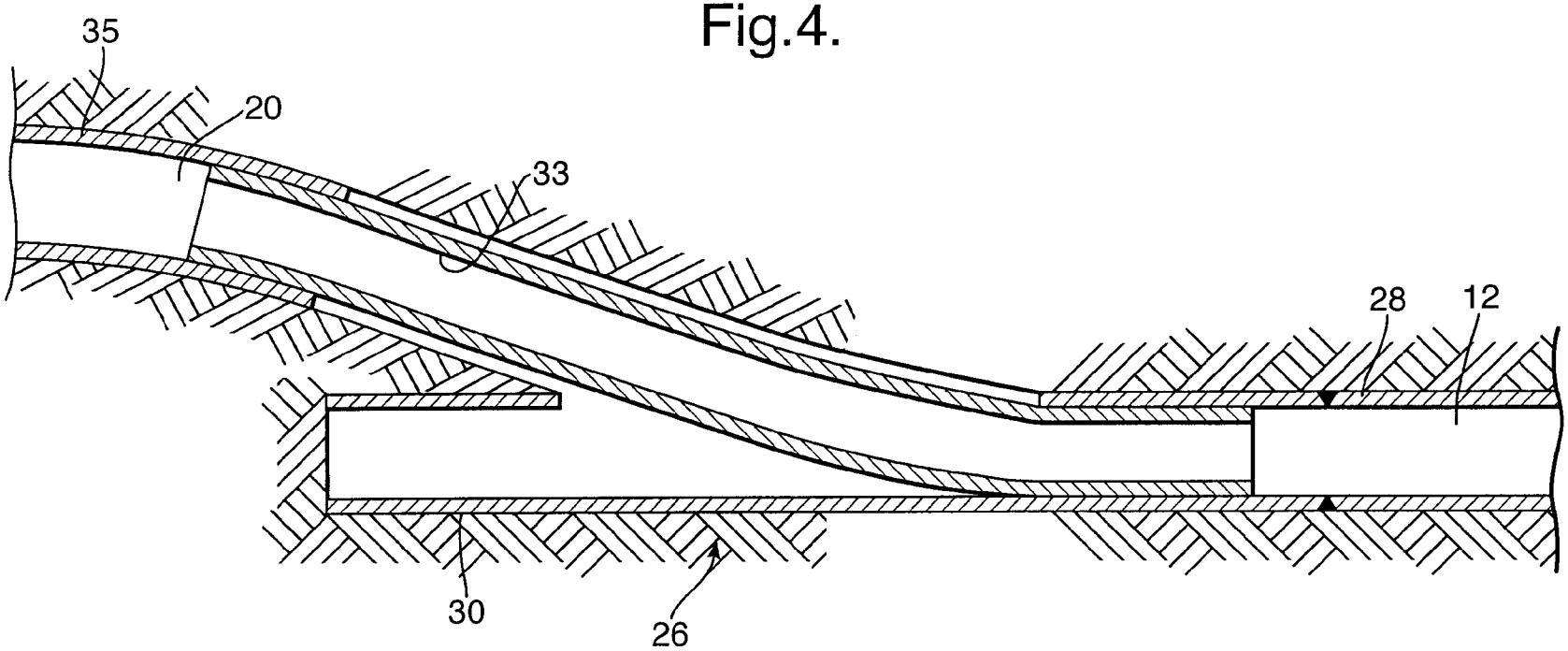
FIG. 4 schematically shows the connection of FIG. 3, during normal operation.

In FIG. 4 is shown the intersection point 26 after removal of the drill string 32 from the deviated wellbore 20. A casing 35 extends from the surface location 22 through the deviated wellbore 20 to the intersection point 26. Furthermore, an expandable tubular element 33 is arranged at the intersection point 26 in a manner that the expandable tubular 33 extends both into the lower end of casing 35 and into the lower end of the casing 28.

Figure 5:
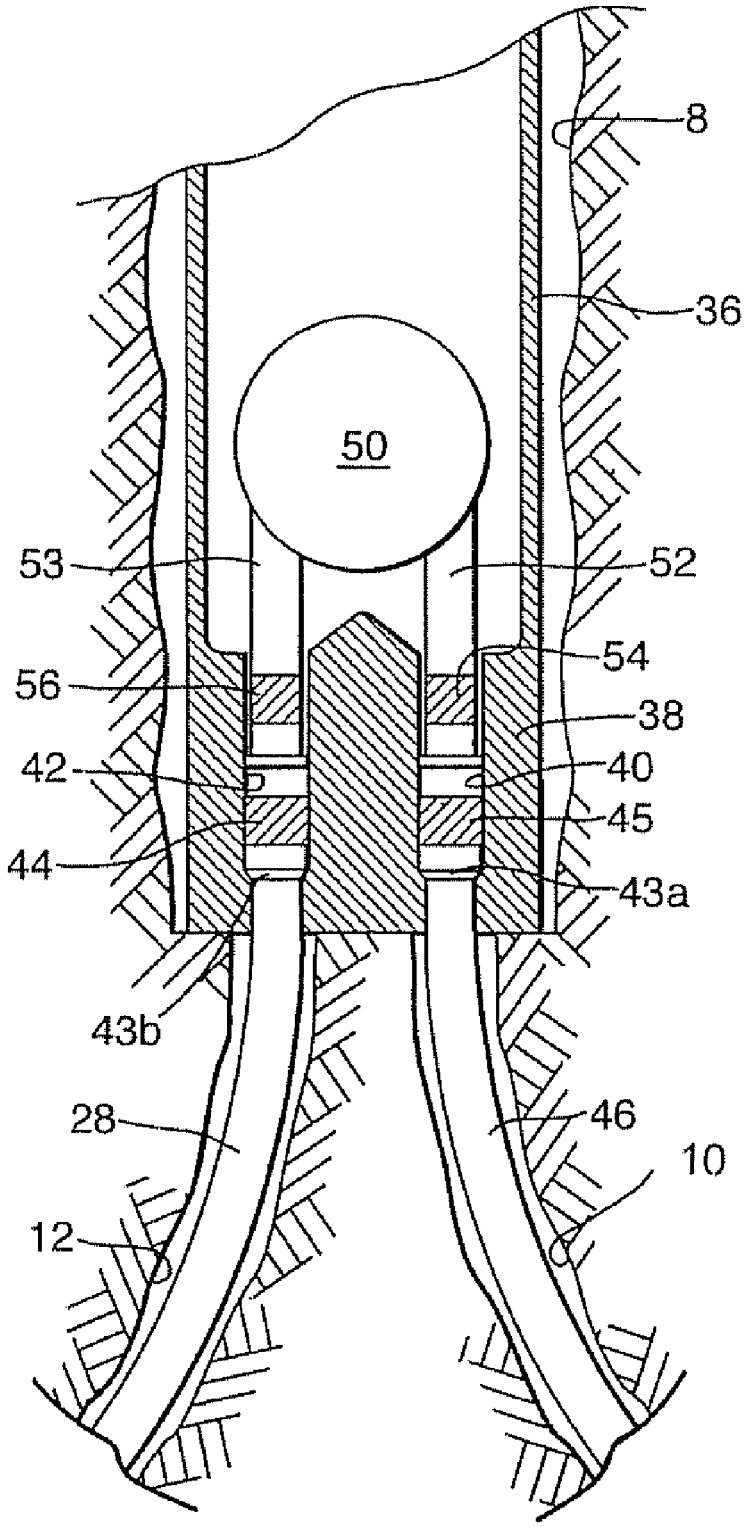
FIG. 5 schematically shows a branch section of a multilateral wellbore forming part of the wellbore system of FIG. 1.

In FIG. 5 is shown a section of the main borehole 8 at the level of the junction with the branch boreholes 10, 12. A casing 36 is installed in the main borehole 8. The casing 36 has at its lower end connected thereto a junction device 38 having a primary through-bore 40 providing fluid communication between the main borehole 8 and the primary branch borehole 10, and a secondary through-bore 42 providing fluid communication between the main borehole 8 and the secondary branch borehole 12. Each through-bore 40, 42 is provided with a respective internal shoulder 43*a*, 43*b* serving a purpose referred to hereinafter.

The casing (or liner) 28 extends from the secondary through-bore 42 into the secondary branch borehole 12. The upper end of casing 28 is provided with an external shoulder cooperating with the shoulder 43*b* so as to support the casing 28 in the secondary through-bore 42. An annular seal 44 seals the upper end of casing 28 to the secondary through-bore 42. Similarly, a casing (or liner) 46 extends from the primary through-bore 40 into the primary branch borehole 10. The upper end of casing 46 is provided with an external shoulder cooperating with the shoulder 43*a* so as to support the casing 46 in the primary through-bore 40. An annular seal 45 seals the upper end of casing 46 to the primary through-bore 40.

A pump 50 is arranged in the main borehole 8 at a location above the junction device 38. The pump 50 has an inlet 52 in fluid communication with the primary through-bore 40 and sealed thereto by an annular seal 54, and an outlet 53 in fluid communication with the secondary through-bore 42 and sealed thereto by an annular seal 56. The pump 50 is driven by an electric motor (not shown) receiving power from the surface location 22 via an electric line (not shown) extending through the deviated wellbore 20 and the secondary branch borehole 12 to the electric motor. The electric line is connected to the electric motor via a passage (not shown) provided in junction device 38, or via the outlet 53.

The SCSSV 15 is electrically or hydraulically controlled from the surface location 22 via an electric or hydraulic control line, such as an umbilical, which extends through the deviated wellbore 20, the secondary branch borehole 12, and a portion of the primary branch borehole 10, to the SCSSV 15.

During normal operation the multilateral wellbore 6 is drilled from the drilling vessel 16 using a drill string (not shown) passing via the riser 18 into the main borehole 8. Thereafter the casing 36 with the junction device 38 connected thereto is installed in the main borehole 8. The branch boreholes 10, 12 are drilled after the casing 36 and the junction device 38 have been installed, whereby the drill string is guided through the through-bores 40, 42 of the junction device 38 to drill the respective branch boreholes 10, 12. Alternatively the branch boreholes 10, 12 are drilled before the casing 36 and the junction device 38 are installed.

After the primary branch borehole 10 has been drilled, the casing 46 is installed therein and the primary branch borehole 10 is completed with a conventional wellbore completion, for example a production tubing, a production liner and one or more sandscreens (not shown) located in the reservoir 4. The SCSSV 15 is positioned in the primary branch borehole 10, near the junction with the main borehole 8. The function of the SCSSV 15 is to allow the flow of hydrocarbon fluid through the production tubing in the primary branch borehole 10 to be controlled, for example by closing the SCSSV 15 in case of an emergency.

After the secondary branch borehole 12 has been drilled, the casing 28 is installed therein such that its non-magnetisable lower portion 30 is located in the lower end part of the branch borehole 12.

The pump 50 is then installed in the main borehole 8 such that its inlet 52 extends into the primary through-bore 40 of the junction device 38 and its outlet 53 extends into the secondary through-bore 40 of the junction device 38.

In a next step the deviated wellbore 20 is drilled from the onshore drilling rig 24. Drilling of the deviated wellbore 20 also can be carried out simultaneously with drilling of the multilateral wellbore 6. As the deviated wellbore 20 approaches the secondary branch borehole 12, the magnetic field sensor in the drill string 32 is used to steer the drill string 32 towards the magnets in the non-magnetisable end portion 30 of the liner 28. Such method of drill string steering is known from conventional homing-in techniques normally applied to drill a relief well in case of a blowout. Drilling of the deviated wellbore 20 is continued until it connects to, and is substantially aligned with, the secondary branch borehole 12. The drill string 32 is then retrieved from the deviated wellbore 20, and the casing 35 is installed in the deviated wellbore 20. The expandable tubular element 33 is then lowered through the casing 35 to the intersection point 26. Subsequently, one end portion of the expandable tubular element 33 is manoeuvred into the casing 28 of the secondary branch borehole 12 while the other end portion remains in the casing 35 of the deviated wellbore 20. The tubular element 33 is then radially expanded against the respective walls of the casings 28, using an expander (not shown) that is pumped, pulled or pushed through the tubular element 33 in conventional manner.

Upon completion of the multilateral wellbore 6, the drilling vessel 16 and the riser 18 are moved away from the location of the wellbore 6. Upon completion of the deviated wellbore 20, the drilling rig 24 is removed from the surface location 22. A conventional production manifold (not shown) is connected at the wellhead of deviated wellbore 20, and a production facility (not shown) is brought in fluid communication with the production manifold.

When the wellbore system 1 is taken in production, a stream of hydrocarbon fluid flows from the reservoir formation 4 into the production tubing of the primary branch borehole 10 and thence via the inlet 52 to pump 50. The pump 50 is operated to pump the stream of hydrocarbon fluid via the outlet 53 into the casing 28 of the secondary branch borehole 12. At the intersection point 26, the stream flows into the expanded tubular element 33 and from there via casing 35 of the deviated wellbore 20 to the production facility at the surface location 22. Thus, the primary branch borehole 10 serves as a production well with a conventional completion, while the secondary branch borehole and the deviated wellbore 20 serve as an underground transport conduit hydrocarbon fluid.

In this manner it is achieved that hydrocarbon fluid is produced from an offshore location to an onshore production facility, without the need for a subsea pipeline or a permanent offshore production platform.

If the reservoir pressure is sufficiently high to allow hydrocarbon fluid to flow to the production facility without pumping, the pump can be dispensed with. In that case the through-bores of the junction device can be directly in fluid communication with each other.

In case a workover operation is required during the lifetime of the wellbore system, such operation suitably is conducted through the main borehole of the multilateral wellbore using an offshore workover rig.

What is claimed is:

1. A wellbore system for the production of hydrocarbon fluid from a hydrocarbon fluid reservoir in an earth formation, the wellbore system comprising:

a first wellbore drilled from a first surface location at a horizontal distance from the hydrocarbon fluid reservoir, the first wellbore having a lower section extending from a rock formation outside the reservoir, into the reservoir; and a second wellbore drilled from a second surface location horizontally displaced from the first surface location, the second wellbore extending towards the first wellbore and being in fluid communication with the reservoir via said lower section of the first wellbore, wherein the first wellbore is a multilateral wellbore comprising a main borehole and primary and a secondary branch boreholes extending from the main borehole, wherein said lower section of the first wellbore is formed by the primary branch borehole, and wherein said second wellbore is fluidly connected to the secondary branch borehole.

2. The wellbore system of claim 1, wherein the main borehole is provided with a junction device having a primary through-bore in fluid communication with the primary branch borehole and a secondary through-bore in fluid communication with the secondary branch borehole.

3. The wellbore system of claim 2, wherein the main borehole is provided with a pump arranged to pump hydrocarbon fluid from the primary branch borehole into the secondary branch borehole.

4. The wellbore system of claim 3, wherein the pump has an inlet in fluid communication with the primary through-bore of the junction device, and an outlet in fluid communication with the secondary through-bore of the junction device.

5. The wellbore system of claim 1, wherein the first wellbore is provided with a closure device arranged to prevent flow of hydrocarbon fluid through the first wellbore to said first surface location.

6. The wellbore system of claim 5, wherein the closure device is arranged at a location below said first surface location.

7. The wellbore system of claim 5, wherein the closure device is adapted to be opened so as to selectively allow passage of wellbore tools from the first surface location, through the first wellbore, to a location down-hole of the closure device.

8. The wellbore system of claim 1, wherein the second wellbore is fluidly connected to the first wellbore by means of a tubular element extending into the first wellbore and into the second wellbore.

9. The wellbore system of claim 8, wherein said tubular element is an expandable tubular element having an end portion radially expanded against a tubular wall of the first wellbore and another end portion radially expanded against a tubular wall of the second wellbore.

10. The wellbore system of claim 9, wherein said end portion of the tubular element is expanded against a casing of the first wellbore, and wherein said another end portion of the tubular element is expanded against a casing of the second wellbore.

11. The wellbore system of claim 1, wherein said lower section of the first wellbore is provided with a wellbore completion including a subsurface safety valve.

* * * * *